US006152631A

United States Patent [19]

Park

[11] Patent Number: 6,152,631

[45] Date of Patent: Nov. 28, 2000

[54] AUTOMATIC PAPER SENSING TECHNIQUE FOR AN INK JET PRINTER

[75] Inventor: Dong-Chae Park, Yongin, Rep. of Korea

[73] Assignee: SamSung Electronics Co., Ltd., Suwon, Rep. of Korea

[21] Appl. No.: 09/215,348

[22] Filed: Dec. 18, 1998

Related U.S. Application Data

[63] Continuation-in-part of application No. 08/858,443, May 19, 1997, abandoned.

[30] Foreign Application Priority Data

May 18, 1996 [KR] Rep. of Korea ..... 96-16829

[51] Int. Cl.[7] ..... B41J 29/44

[52] U.S. Cl. ..... 400/708; 271/265.01; 271/10.03

[58] Field of Search ..... 400/708, 624, 400/629, 636, 637, 637.1, 582; 271/10.03, 10.11, 285.01, 265.01, 256, 258.01, 258.02, 259

[56] References Cited

U.S. PATENT DOCUMENTS

| | | | |
|---|---|---|---|
| 4,655,626 | 4/1987 | Okazaki | 400/708 |
| 4,671,441 | 6/1987 | Hauslaib | 400/708 |
| 4,690,577 | 9/1987 | Kikuchi et al. | 400/708 |
| 5,082,384 | 1/1992 | Kakaguchi | 400/708 |
| 5,171,006 | 12/1992 | Naito | 271/9 |
| 5,209,591 | 5/1993 | Mizutani et al. | 400/645 |
| 5,230,573 | 7/1993 | Yasuoka et al. | 400/708 |
| 5,259,607 | 11/1993 | Hironori et al. | 271/10 |
| 5,291,224 | 3/1994 | Asano et al. | 400/641 |
| 5,362,038 | 11/1994 | Giles et al. | 271/10 |
| 5,419,543 | 5/1995 | Nakamura et al. | 271/9 |
| 5,582,399 | 12/1996 | Sugiura | 271/10.11 |

*Primary Examiner*—John S. Hilten
*Assistant Examiner*—Leslie J. Grohusky
*Attorney, Agent, or Firm*—Robert E. Bushnell, Esq.

[57] ABSTRACT

An automatic paper sensing apparatus for an ink jet printer which can supply and print sheets of paper can automatically subsequently sense the existence of paper when a message indicating the absence of paper is generated. A first arm is fixed to the actuator feed in the direction of a separator, a second arm is mounted rotatably around a hinge axis at one side of the separator moved by an adjustable lever so as to interlock slidably with the first arm, the second arm being supported elastically by a tension coil spring fixed at one side thereof to the separator, one side of the actuator feed can be attached and detached to and from an optical sensor by means of the interlocking of the first and second arms. When the actuator feed and the separator are provided with an arm which is slidably interlocked with each other, the automatic sensing apparatus can automatically sense the subsequent existence of paper in order to facilitate convenient use of the printer.

18 Claims, 9 Drawing Sheets

AUTOMATIC PAPER SENSING TECHNIQUE FOR AN INK JET PRINTER

CROSS-REFERENCE TO RELATED APPLICATIONS

This application is a continuation-in-part of application Ser. No. 08/858,443, filed in the U.S. Patent & Trademark Office on May 19, 1997, now abandoned.

CLAIM FOR PRIORITY

This application makes reference to and claims all benefits accruing under 35 U.S.C. §119 and §120 from an application for AUTOMATIC PAPER SENSING APPARATUS FOR AN INK JET PRINTER earlier filed in the Korean Industrial Property Office on May 18, 1996 and there duly assigned Serial No. 16829/1996.

BACKGROUND OF THE INVENTION

1. Technical Field

The present invention relates to a technique for automatically sensing the feeding of individual sheets of paper in an ink jet printer, and more particularly, relates to an automatic paper sensing apparatus of an ink jet printer for automatically sensing a feeding state of successive sheets of paper.

2. Related Art

Conventional paper feeding structure in an ink jet printer is classified into two types. The first type as disclosed, for example, in U.S. Pat. No. 5,171,006 for Sheet Material Feeding Device issued to Naito, U.S. Pat. No. 5,209,591 for Sheet Guide Mechanism For A Printer issued to Mizutani et al., and U.S. Pat. No. 5,582,399 for Sheet Feeding Device Having Sheet Edge Sensor issued to Sugiura, relates to a paper cassette containing a stack of paper mounted with a slight gradient on the rear side of the main frame of the printer so that a plurality of sheets of paper stacked in the paper cassette are fed one by one toward a printer head for printing by a feed roller. The second type as disclosed, for example, in U.S. Pat. No. 5,259,607 for Automatic Paper Feeding Device issued to Hironori et al., U.S. Pat. No. 5,291,224 for Sheet Feeding Apparatus Using Pairs Of Spur Rollers issued to Asano et al., and U.S. Pat. No. 5,362,038 for Sheet Feeder For Computer Driven Printer issued to Giles et al., relates to a paper cassette containing a stack of paper mounted at the lower part of the printer so that a plurality of sheets of paper stacked in the paper cassette are fed one by one by a pick-up roller toward a printer head for printing by a feed roller.

Generally, in an ink jet printer in which the cassette is mounted upright on the rear side of a body of the printer, individual sheets of paper are fed one by one toward a printer head mounted on a carrier by a feed roller and then are printed while each sheet of paper passes through the printer head which reciprocates from side to side on a shaft. After each sheet of paper is printed by the printer head, the printed sheet of paper is fed toward a discharge tray by a discharge roller. An exemplary paper feed sensing apparatus typically includes an optical sensor and an actuator feed which determines related rotational direction of a motor after sensing the existence of the paper. When the paper is not present in the paper feeding structure, the actuator feed interrupts the optical sensor so that the paper feed sensing apparatus can sense that a paper is not present. Conversely, when the paper is present in the paper feeding structure, the optical sensor causes one end of the actuator feed to move upwardly so that the paper feed sensing apparatus can sense that the paper is present. However, if a message indicating that the paper is not present is generated during a printing operation, paper can only be subsequently printed by manually pushing a paper supply button mounted separately on the ink jet printer. If the paper supply button is not mounted on the ink jet printer, then the user must first turn off the power supply and turn the power supply back on before a printing operation can be initiated to print information on successive sheets of paper. This requirement of a paper supply button, as I have observed, is unnecessarily complicated and cost prohibitive. Accordingly, further improvement in an automatic paper sensing mechanism of an ink jet printer can be contemplated.

SUMMARY OF THE INVENTION

It is therefore an object of the present invention to provide an automatic paper feed sensing apparatus of an ink jet printer, for example, for automatically subsequently sensing a feeding state of successive sheets of paper without the use of a paper supply button.

It is also an object to provide an automatic paper feed sensing apparatus of an ink jet printer, for example, for sensing a feeding state of sheets of paper through an interlocking operation of a separator by causing an adjustable lever to be actuated after loading paper in a paper cassette without using a separate paper supply button in order to reduce the number of parts necessary.

It is another object to provide an automatic paper feed sensing apparatus of an ink jet printer, for example, including a sensor, such as an optical sensor, for example, for sensing a feeding state of successive sheets of paper through an interlocking operation of a separator by causing an adjustable lever to be actuated after loading paper in a paper cassette without using a separate paper supplying button in order to enhance versatility of the printer.

These and other objects of the present invention can be achieved by an automatic paper feed sensing apparatus of an ink jet printer, for example, for sensing the existence of a paper, which includes an actuator feed movable according to the feeding of individual sheet of paper; a sensor, such as an optical sensor, for example, operated in accordance with attachment to and detachment from the actuator feed, for sensing a feeding state of each individual sheet of paper; wherein a first arm is fixed to the actuator feed in the direction of a separator, a second arm is mounted rotatable around a hinge axis at one side of the separator moved by an adjustable lever so as to interlock slidingly with the first arm, the second arm being supported elastically by an elastic body such as a tension coil spring, for example, fixed at one side thereof to the separator, one side of the actuator feed being attached and detached to and from the optical sensor by means of the interlocking of the first and second arms.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
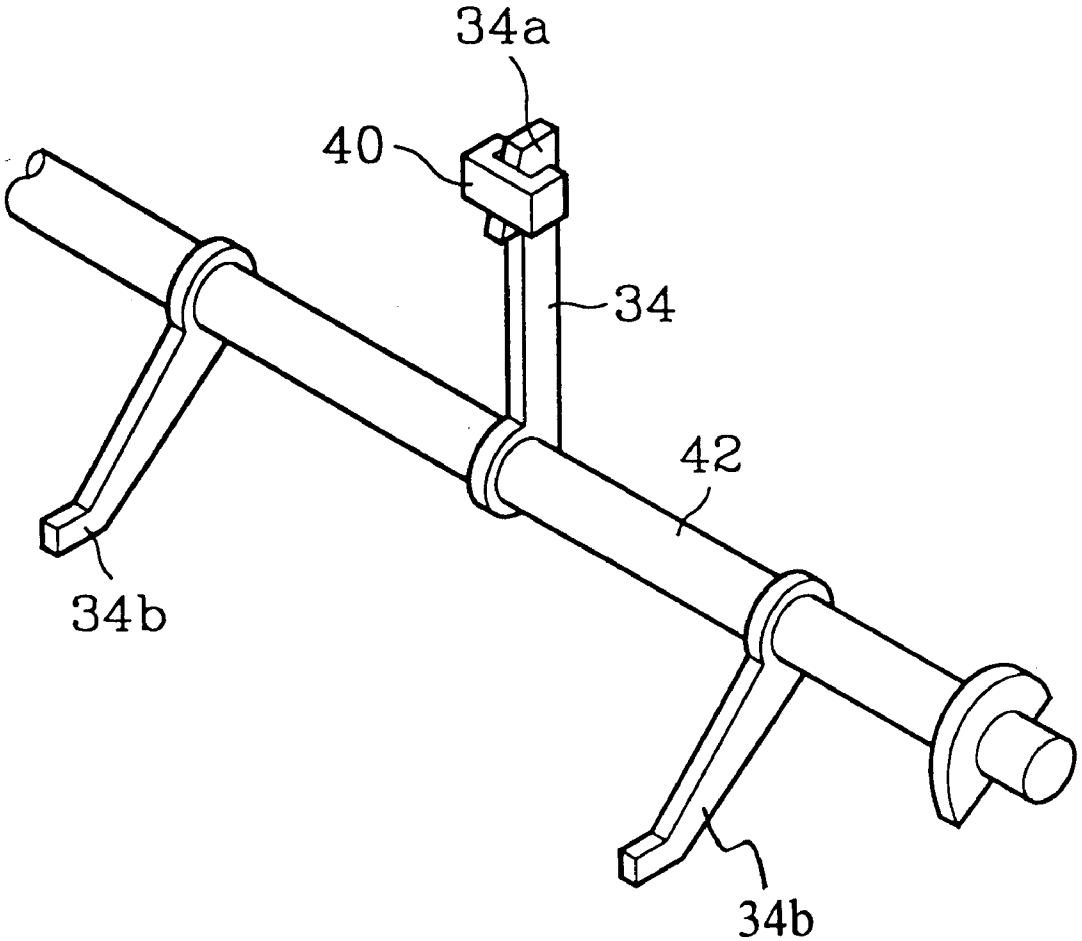
FIG. 1 is a partial perspective of an exemplary paper feed sensing apparatus of an ink jet printer.

Now, a preferred embodiment of the present invention will be described in detail with reference to the accompanying drawings. Throughout the drawings, it is noted that the same reference numerals or letters will be used to designate like or equivalent elements having the same function. In the following description, numeral specific details are set forth to provide a more through understanding of the present invention. It will be apparent, however, to one skilled in the art that the invention may be practiced without their specific details. The detailed descriptions on known function and constructions unnecessarily obscuring the subject matter of the present invention will be avoided hereinafter. Technical terms as will be mentioned hereinbelow are terms defined in consideration of the function in the present invention, which may be varied according to the intention of user, so the terms should be defined based on the contents across all of this specification.

Figure 2:
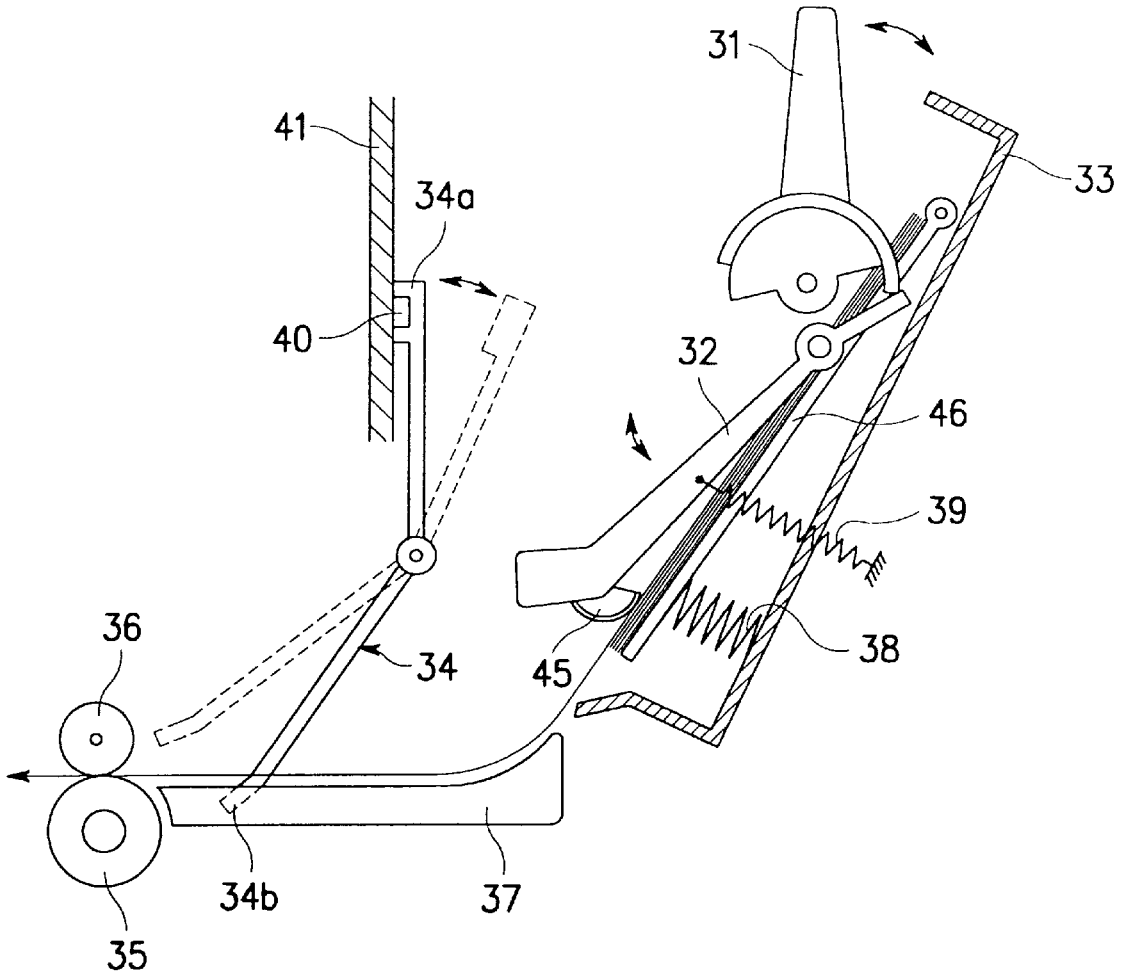
FIG. 2 is a schematic side view of an exemplary paper feed sensing apparatus of an ink jet printer.

FIGS. 1 and 2 illustrate an exemplary paper feed sensing apparatus of an ink jet printer for sensing the feeding state of individual sheets of paper. The paper sensing apparatus includes an actuator feed 34 having an upper end 34*a* and extending from a shaft 42 with lower ends 34*b*. A paper cassette 33 is mounted with a slight gradient on the rear side of a body of the printer, and a knock-up plate 46 is pressed toward the side of a feed roller 45 by a compression coil spring 38 interposed between one side of the knock-up plate 46 and the paper cassette 33. The knock-up plate 46 is contained in the paper cassette 33 for supplying paper in a stacked state, and is elastically fixed to the paper cassette 33 with the compression coil spring 38 in order to feed each individual sheet of paper toward a printer head by way of a feed roller 45. At this time, when each paper being fed by the paper feed roller 45 is passing through a bottom frame 37 of the ink jet printer, its front end is brought into contact with the actuator feed 34. The feed force of the paper feed roller 45, which is a frictional force between the paper feed roller 45 and the paper, pushes the paper toward one side of the actuator feed 34. The paper is fed to the feed rollers 35, 36 while lifting lower end 34*b* of actuator feed 34. At this time, before the front end of the paper is brought into contact with lower end 34*b* of the actuator feed 34, the upper end 34*a* of the actuator feed 34 is attached to an optical sensor 40 connected a printed circuit board 41. When the front end of the paper is brought into contact with the lower end 34*b* of the actuator feed 34 to be fed to the feed rollers 35 and 36, the upper end 34*a* of the actuator feed 34 is detached from the optical sensor 40 (the part shown in dotted line in FIG. 2) which allows the paper to pass through the feed rollers 35, 36 to be printed at a printing section of the ink jet printer.

The operation of an exemplary paper feed sensing apparatus will be described as follows. The paper feed sensing apparatus which comprises an optical sensor 40, an actuator feed 34 and a spring (not shown) determines related rotational direction of a motor after sensing the existence of the paper. When the paper is not present in a feeding path from the paper cassette 33, the actuator feed 34 interrupts the optical sensor 40 so that the paper sensing apparatus can sense that a paper is not present. Conversely, when the paper is present in the feeding path, the lower end 34*b* of the actuator feed 34 is lifted upwardly as the actuator feed 34 is rotated in a clockwise direction, thereby detaching its upper end 34*a* from the optical sensor 40 so that the paper sensing apparatus can sense that a paper is present in the feeding path.

However, if a message indicating that paper is not present in the feeding path is generated during a printing operation, sheets of paper subsequently loaded in a paper cassette cause an adjustable lever 31 to be rotated in a counterclockwise direction. Then, after a separator 32 causes the adjustable lever 31 to be rotated, the newly loaded paper can only be printed on by pushing a paper supply button mounted separately on the ink jet printer. If the paper supply button is not mounted on the ink jet printer however, the user must first turn off the power supply and turn the power supply back on before a printing operation can be initiated to print information on successive sheets of paper. This requirement of a paper supply button, as I have described above, is unnecessarily complicated and cost prohibitive.

Figure 3:
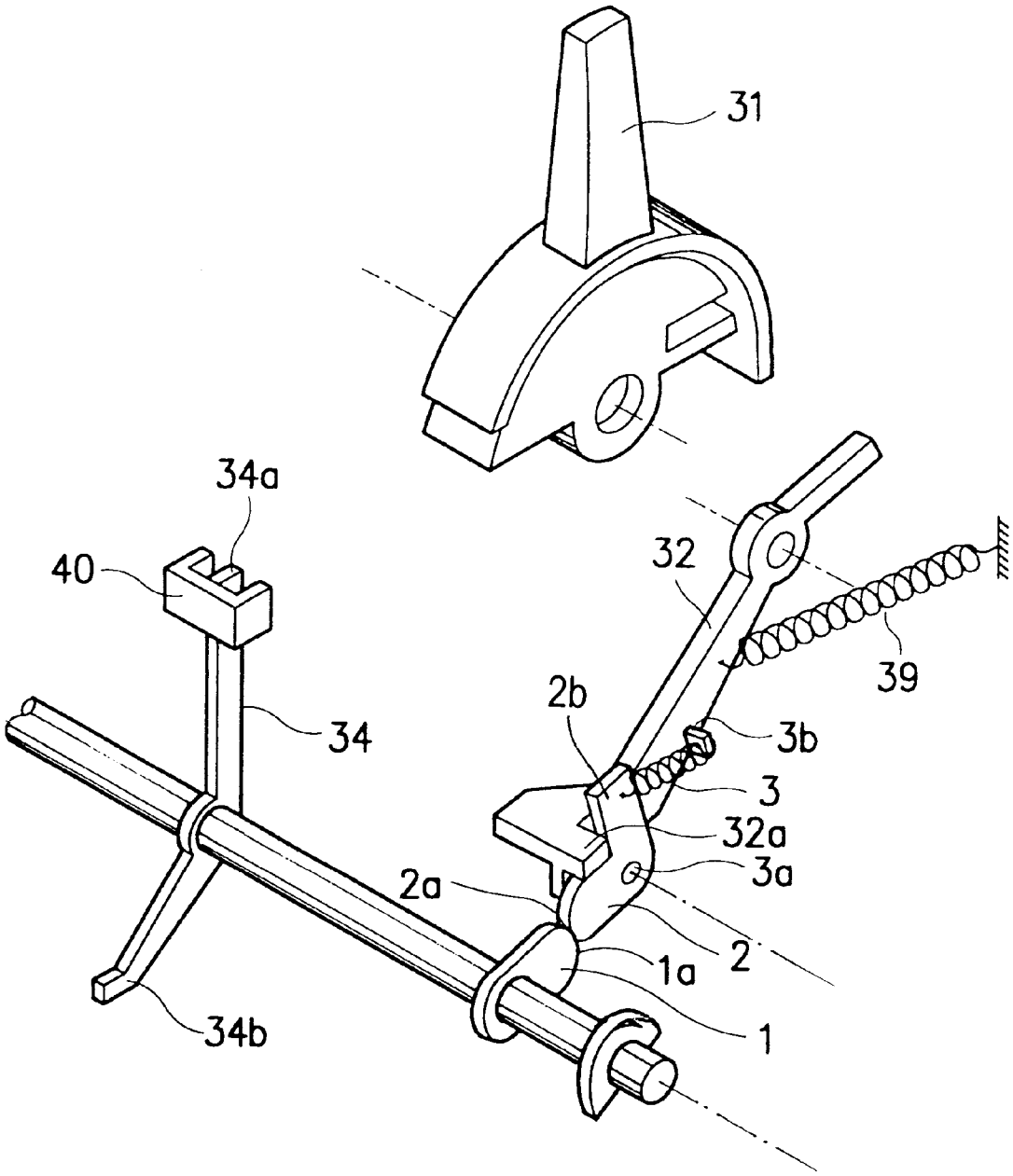
FIG. 3 is a partial perspective view of an automatic paper feed sensing apparatus of an ink jet printer constructed according to the principles of the present invention.

Turning now to FIG. 3 which is a partial perspective view of an automatic paper feed sensing apparatus of an ink jet printer constructed according to a preferred embodiment of the present invention. As shown in FIG. 3, the automatic paper feed sensing apparatus is further constructed with a first arm 1 fixed to an actuator shaft 42 for rotating an actuator feed 34 in either a clockwise direction or a counterclockwise direction in response to rotation of a second arm 2 rotatably mounted about a hinge 3*a* at one side of a separator 32 and supported elastically by a tension coil spring 3 mounted at one distal end 2*b* of second arm 2 and separator 32 at a protrusion 3*b* formed on. The first arm 1 is configured in an elliptical shape, and the second arm 2 is configured in a L-shape. The first and second arms 1, 2 each has a curved sliding surface 1*a* and 2*a* so that when the second arm 2 is interlocked with the first arm 1, opposite sliding surfaces of the first and second arms 1, 2 are brought into contact with each other. When an adjustable lever 31 is rotated by the user, the separator 32 which is interlocked with the adjustable lever 31 rotates in response thereto, and the knock-up plate 46 of the paper cassette 33 which is supported elastically by a coil spring 38 mounted therein provides the feeding of each sheet of paper contained in the paper cassette 33. When the separator 32 rotates in response to the rotation of the adjustable lever 31, an extended portion 32*a* formed on separator 32 contacts second arm 2 and cause second arm 2 to rotate about hinge 3*a*. Second arm 2 which is pivoted about a hinge axis at one end of the separator 32 and elastically supported by the coil spring 3 pushes the first arm 1 via their respective curved sliding surface 1*a*, 2*a* to rotate the actuator feed 34 so that an upper end 34*a* of the actuator feed 34 can be attached to and detached therefrom an optical sensor 40 for operation to sense automatically that a paper is present in a feeding path of an ink jet printer. That is, the upper end 34*a* of the actuator feed 34 pivots about its axis so as to engage and detach from the optical sensor 40 by means of the interlocking action of the first and second arms 1, 2 so that the optical sensor 40 can automatically sense the existence of a paper in the feeding path.

The operation of the automatic paper feed sensing apparatus constructed according to the principles of the present invention will now be described with reference to FIGS. 4A–4E.

Figure 4A:
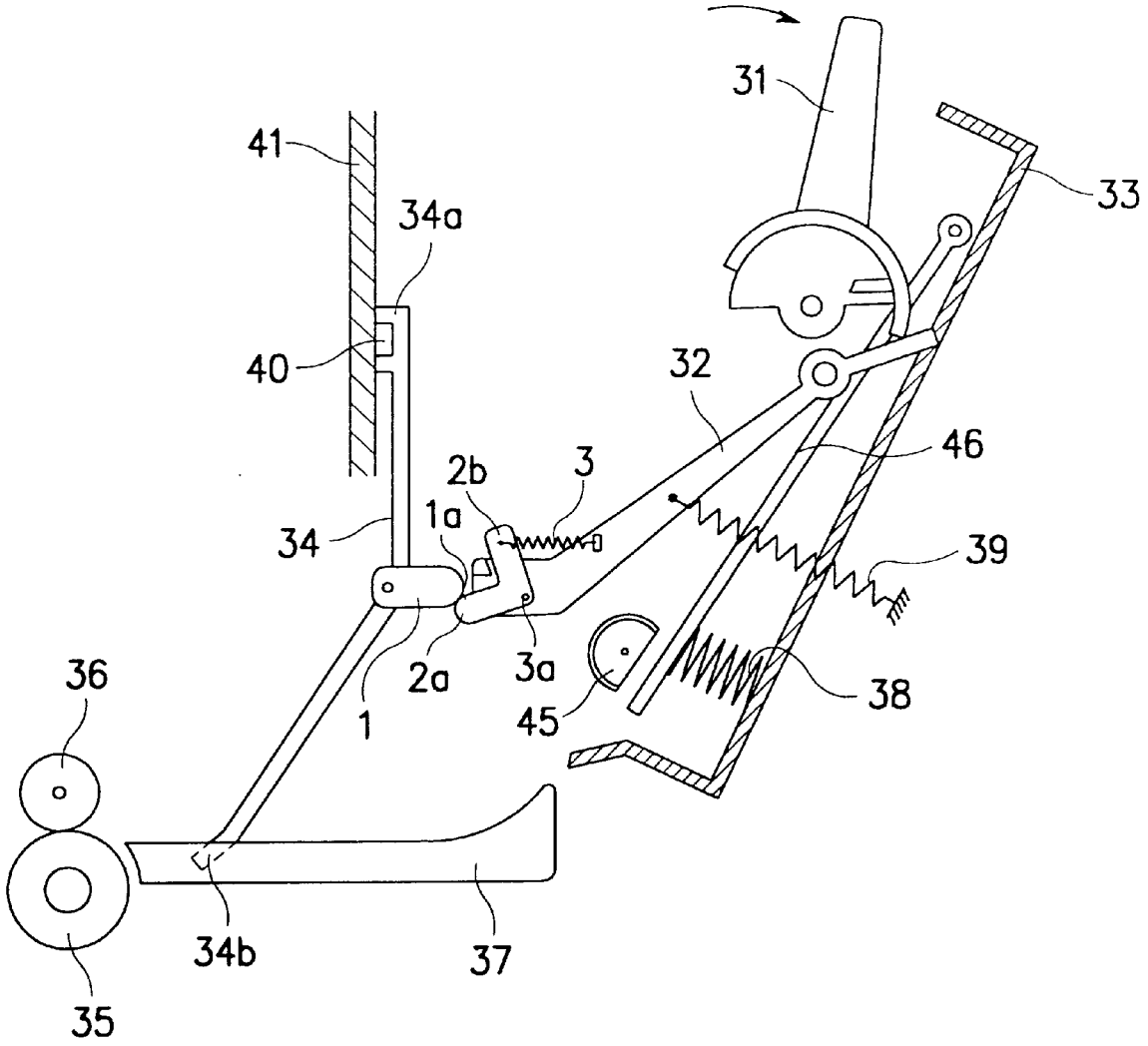
FIGS. 4A–4E are schematic side views of an operating state of an automatic paper feed sensing apparatus of an ink jet printer constructed according to the principles of the present invention.
Figure 4B:
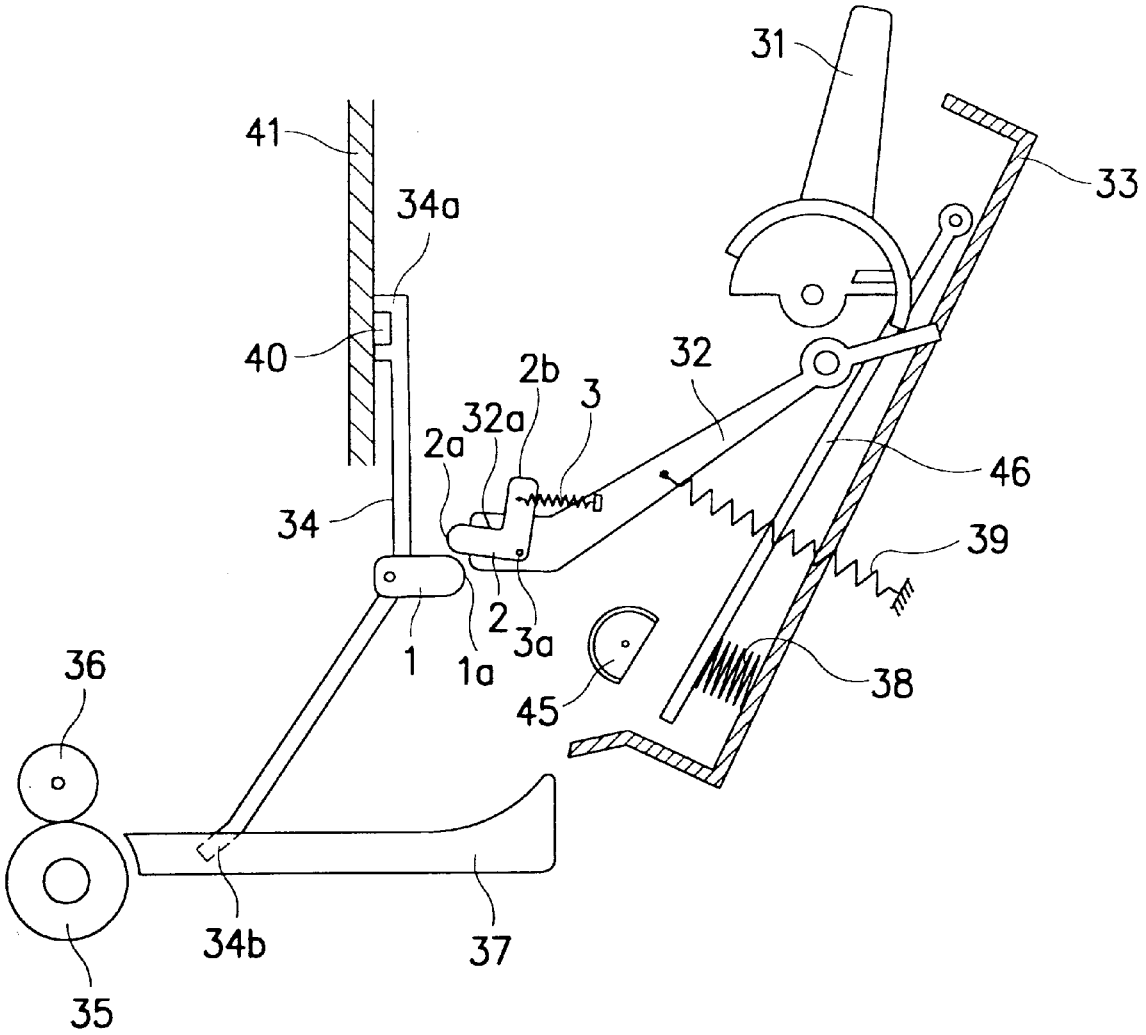
Figure 4C:
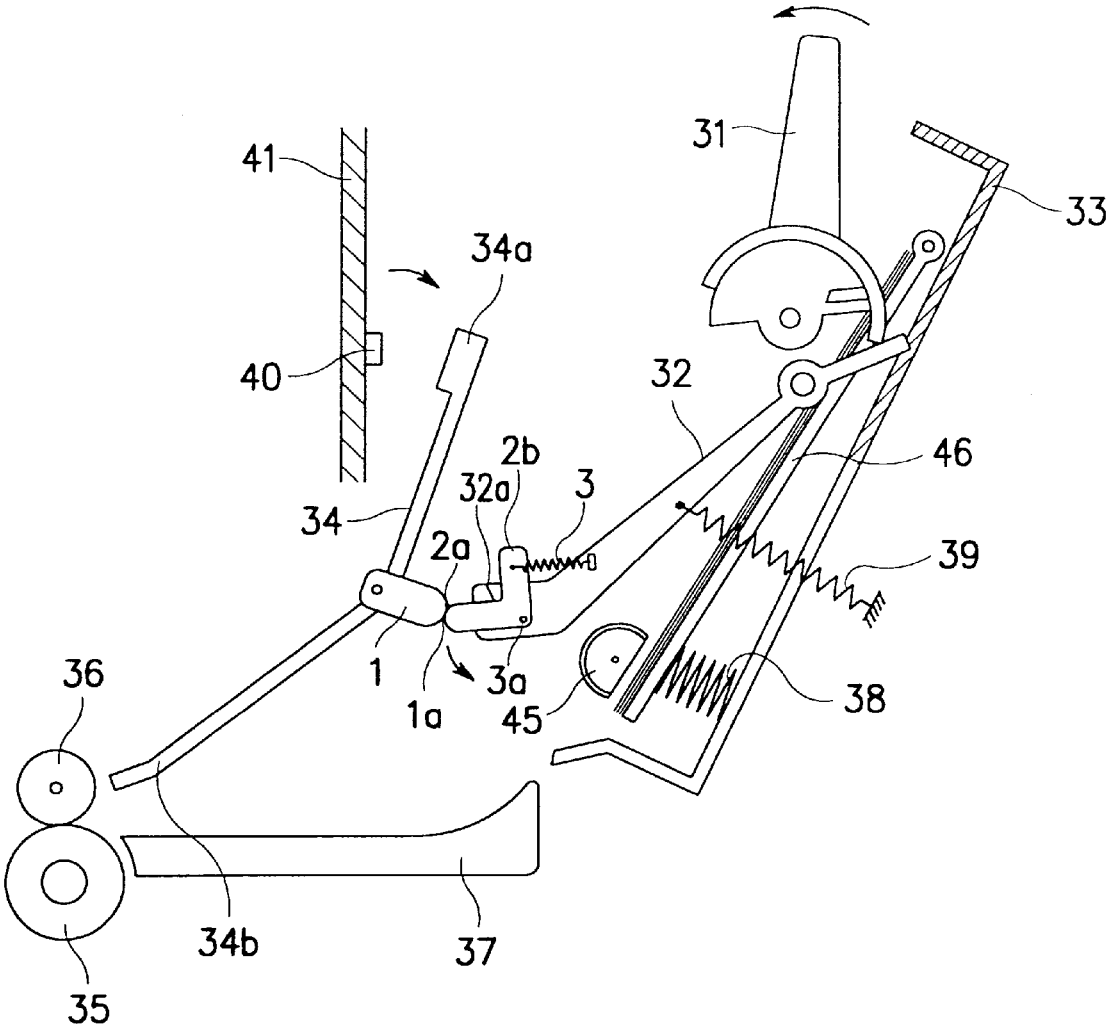
Figure 4D:
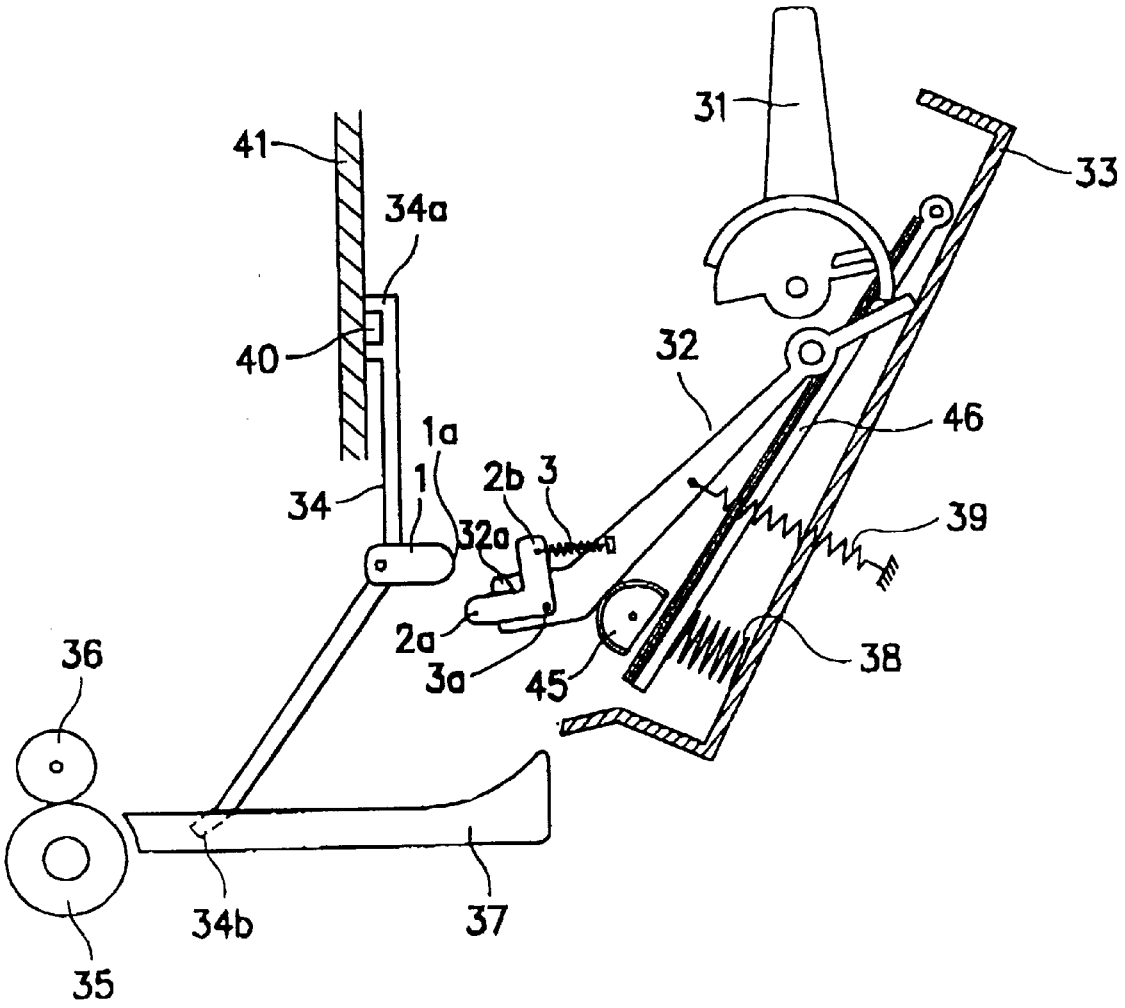
Figure 4E:
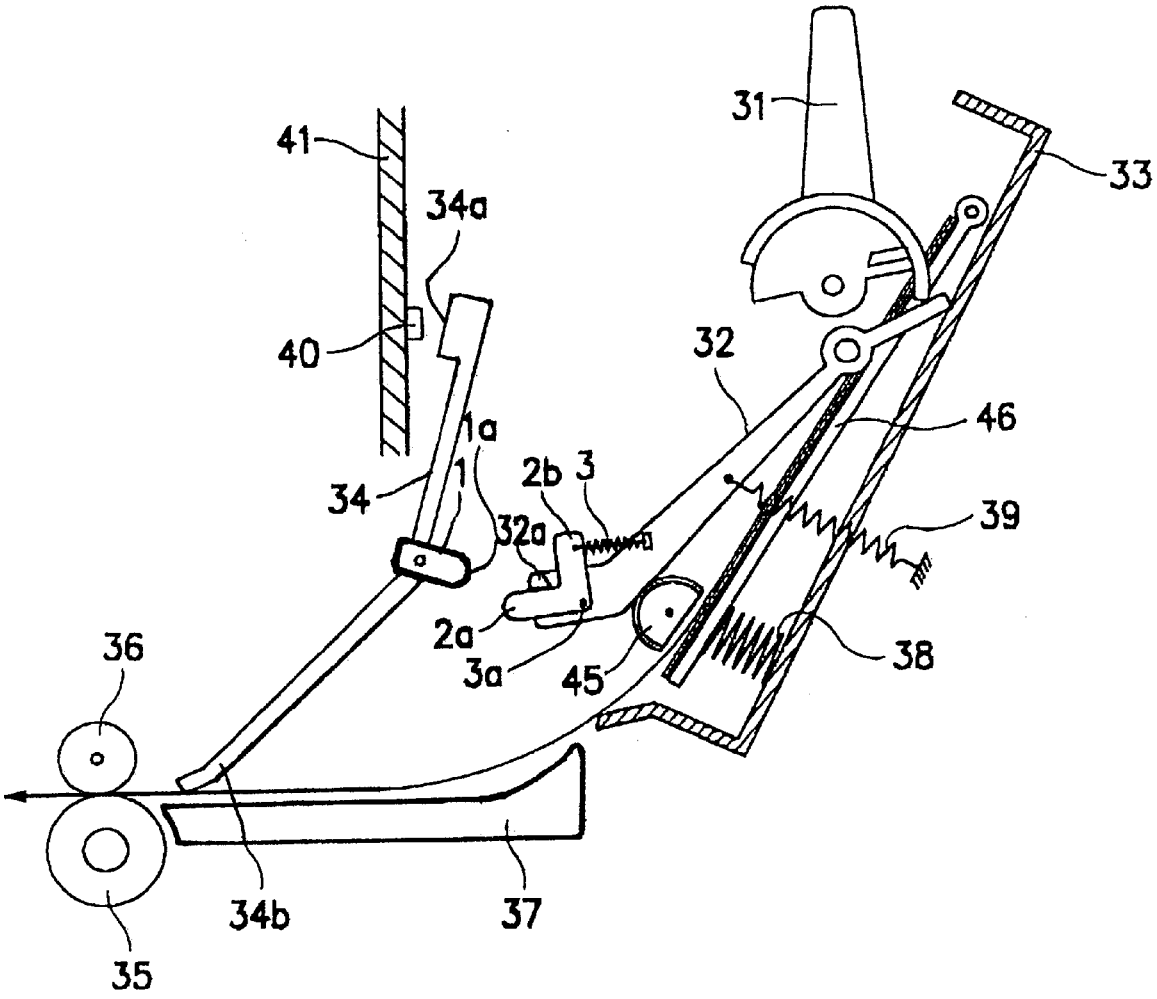

As shown in FIG. 4A, when a message indicating that a paper is not present is displayed on an operational panel, the user rotates an adjustable lever 31 in a clockwise direction before loading sheets of paper onto the knock-up plate 46 in the paper cassette 33. The optical sensor 40 is interrupted by one side end 34*a* of the actuator feed 34 so that it does not operate. The separator 32 is interlocked with the adjustable lever 31, and is moved upward to slide surface 1*a* of first arm 1 when the slide surface 2*a* of second arm 2 is rotated in a counterclockwise direction. FIG. 4B illustrates an operational state of the actuator feed 34 and the optical sensor 40 when the adjustable lever 31 is rotated in a clock wise direction before loading paper on the knock-up plate 46. FIG. 4C illustrates an operational state of the actuator feed 34 and the optical sensor 40 when the adjustable lever 31 is begun to be rotated in a counterclockwise direction after loading the paper on the knock-up plate 46. When the user rotates the adjustable lever 31 in a counterclockwise direction after loading a plurality of sheets of paper, the separator 32 is rotated in a counterclockwise direction by restoring the force of the compression coil spring 39 installed in separator 32. At this time, the second arm 2 of separator 32 pushes the first arm 1 of actuator feed 34 downward for rotation in a clockwise direction in order to switch on the optical sensor 40. At the same time, the knock-up plate 46 is moved upward by compression coil spring 38. In FIG. 4D, when the adjustable lever 31 is rotated in a counterclockwise direction as shown in FIG. 4C, the second arm 2 of separator 32 is detached from the first arm 1 of actuator feed 34. At this time, the actuator feed 34 is rotated counterclockwise toward its original position to switch off the optical sensor 40. At this time, according to TURN ON/OFF of the sensor 40, the controller determines that all sheets of paper are fed and the ink jet printer gets to be in a waiting state, or if data remains to be printed, the ink jet printer continues to print the remaining data.

As can be seen from the description, when a message indicating that a paper is not present is generated, the user rotates the adjustable lever 31 in a clockwise direction so as to load sheets of paper in a paper cassette 33, and the ink jet printer is in a wait state. The optical sensor 40 is designed to be turned on/off electrically. Therefore, the actions of loading sheets of paper when the message indicating that a paper is not present is displayed on the operational panel, rotating the adjustable lever 31 and pushing paper supply button down, as required in the exemplary paper sensing apparatus can be eliminated, so that when the message indicating that a paper is not present is generated, the user loads sheets of paper in a paper cassette 33 and simultaneously the subsequent existence of paper can be sensed automatically.

When sheets of paper are loaded in the paper cassette 33, the actuator feed 34 is attached to an optical sensor 40. At this time, the optical sensor 40 is interrupted by one side end 34*a* of the actuator feed 34 so that it does not operate. When the user rotates the adjustable lever 31 after loading sheets of paper, the second arm 2 fixed to one side of the separator 32 is interlocked rotatably with the first arm 1 provided on a shaft 42 of the actuator feed 34. Even though the second arm 2 is supported elastically at one side by the tension coil spring 3, the force causing one side of the separator 32 to be supported elastically by the tension coil spring 39 is much greater than that causing one side of the second arm 2 to be supported elastically by the tension coil spring 3 so that one end of the second arm 2 slides along one end surface of the first arm 1 while the second arm 2 is in contact with the first arm 2. At this time, one end of the second arm 2 pushes one end of the first arm 1 so that one side end 34*a* of the actuator feed 34 is detached from the optical sensor 40 in order to sense the existence of paper.

Figure 5:
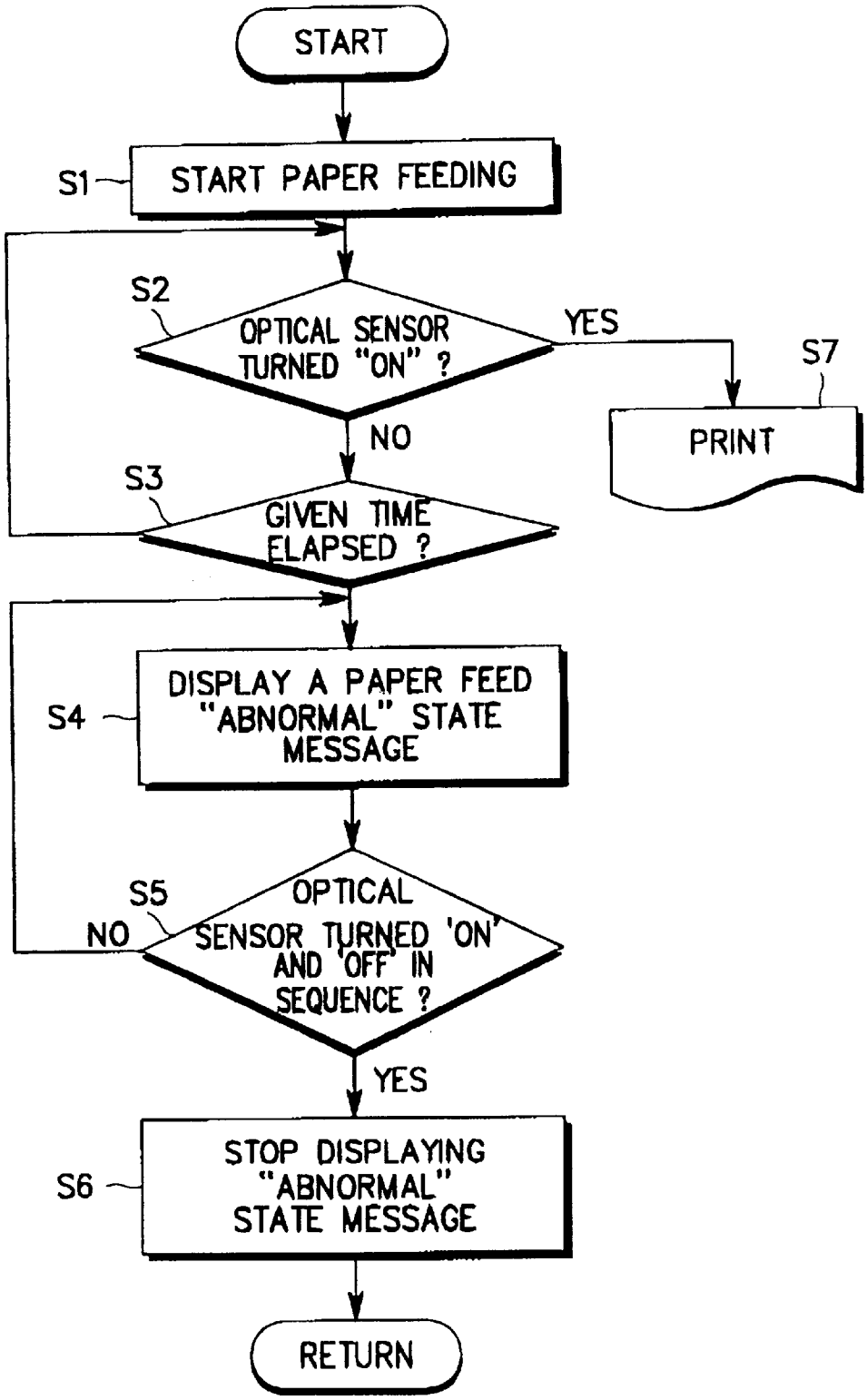
FIG. 5 is a flowchart illustrating the procedure for automatically sensing the feeding of an individual sheet of paper according to the present invention.

FIG. 5 is a flowchart of a procedure for automatically sensing a feeding of an individual sheet of paper according to the present invention. As illustrated in FIG. 5, in step S1, the sheet of paper loaded onto the paper feeder is fed. In step S2, if the sheet of paper is normally conveyed from the paper feeder to thereby turn "ON" an optical sensor, a normal printing operation is performed. To the contrary, if there is no paper in the feeder or a paper jam occurs in the paper feeder to thereby turn "OFF" the optical sensor, the sheet of paper is not conveyed. In step S3, after the optical sensor turns "OFF", it is checked whether a given time duration has elapsed, the duration equal to the time taken for the paper to travel the distance from the paper feeder to one end of the actuator. In step S4, if the sheet of paper is not fed from the paper feeder after the given time duration has elapsed, a message indicating a paper feed abnormal state is displayed on an operator panel of the printer. In step S5, after the sheet of paper is loaded or the jammed paper is eliminated, it is checked whether the turn-on state of the optical sensor is again changed into the turn -off state during the rotation of an adjustable lever for setting the sheet of paper. In step S6, if the turn-on state of the optical sensor is changed into the turn-off state, the message of indicating the paper feed abnormal state is no longer displayed on the operator panel of the printer. If optical sensor is turned on in step S2, printing operation performs in step S7.

As described above, an automatic paper sensing apparatus for an ink jet printer of the present invention has an advantage that by providing the actuator feed and the separator with an arm, and causing the actuator feed and the separator to interlock slidably with each other, the subsequent existence of paper can be automatically sensed, to thereby facilitate convenient use of a printer.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An automatic paper sensing apparatus in a printer, comprising:

an adjustable lever an actuator shaft;

an actuator feed extending from said actuator shaft and moving in response to each passage of an individual sheet of paper during a feed operation while individual sheets of paper are introduced into said printer;

a sensor positioned to sense a feeding state of each individual sheet of paper during each feed operation in accordance with a first movement of said actuator feed;

a separator positioned to respond to said adjustable lever moving when said individual sheet of paper is loaded into a paper cassette;

a first arm pivotably connected to said separator, said first arm displacing said actuator feed when said separator moves in response to a second movement of said adjustable lever, causing said first movement of said actuator feed.

2. The automatic paper sensing apparatus of claim 1, further comprised of a second arm fixed to said actuator feed, contacting said first arm of said separator, displaced with said actuator feed by said first arm of said separator.

3. The automatic paper sensing apparatus of claim 2, further comprised of said first and second arms each having a curved sliding surface so that each surface of distal ends of said first and second arms is brought into contact with each other.

4. An automatic paper feed sensing apparatus in a paper feeding apparatus, comprising:

a paper feeder;

a paper feed sensing unit;

a cassette installed in said paper feeder, for operating in one of a paper feed mode and a paper load mode;

a separator installed in said cassette, for switching operation in one of said paper feed mode and said paper load mode; and a first arm connected to said separator for operating said paper feed sensing unit by a switching operation of said separator.

5. The automatic paper feed sensing apparatus of claim 4, further comprised of a fixing arm formed in said paper feed sensing unit, contacting said first arm, displaced by said first arm causing said paper feed sensing unit to operate.

6. The automatic paper feed sensing apparatus of claim 5, further comprising an elastic body having both ends respectively fixed to one end of said first arm and said separator to provide a restoring force with said first arm.

7. The automatic paper feed sensing apparatus of claim 5, respective distal ends of said fixing arm and said first arm being provided with sliding surfaces for sliding movement of said fixing arm and said first arm.

8. The automatic paper feed sensing apparatus of claim 4, further comprised of said paper feed sensing unit having an actuator feed operating a sensor to sense, by the operation of on/off, whether a paper is fed into the paper feeding apparatus.

9. The automatic paper feed sensing apparatus of claim 4, further comprised of said paper feed sensing unit detecting said paper feed mode of whether a sheet of paper is fed by said paper feeder and said paper load mode of whether said sheet of paper is loaded when said sheet of paper is not fed from said paper feeder.

10. An automatic paper sensing apparatus in a printer, comprising:

an actuator feed disposed on a feeding path of an individual sheet of paper, said actuator feed moving when said individual sheet of paper travels through said feeding path during a feeding operation; and a separator disposed on a cassette, having an arm contacting said actuator feed, said separator moving in response to a loading of said individual sheet of paper into said cassette, and moving said actuator feed indicating paper being loaded when said individual sheet of paper does not travel through said feeding path during said feeding operation.

11. The apparatus of claim 10, further comprised of a sensor disposed to sense said moving of said actuator feed when said individual sheet of paper travels through said feeding path during said feeding operation.

12. The apparatus of claim 11, further comprised of said sensor sensing moving of said actuator feed moving in response to said moving of said separator when said individual sheet of paper does not travel through said feeding path during said feeding operation.

13. The apparatus of claim 10, further comprised of a distal end formed on said arm moving with said separator, contacting said actuator feed, and moving said actuator feed.

14. The apparatus of claim 10, further comprised of a second arm connected to said actuator feed, contacting said first arm of said separator, moving with said actuator feed in response to said moving of said separator.

15. The apparatus of claim 10, further comprised of an elastic body having both ends respectively fixed to one end of said arm and said separator to provide a restoring force with said arm.

16. The apparatus of claim 11, further comprised of a printer performing a printing operation when said sensor senses a feeding state during said feeding operation.

17. The apparatus of claim 16, further comprised of said printer terminating said printing operation and said feeding operation when said sensor does not sense said feeding state.

18. The apparatus of claim 17, further comprised of said printer initiating said feeding operation and said printing operation by said sensor detecting the movement of said arm during loading a paper in said cassette when said sensor does not sense said feeding state in said feeding operation.

* * * * *